United States Patent [19]

Wells

[11] Patent Number: 4,767,241

[45] Date of Patent: Aug. 30, 1988

[54] METHOD FOR SIMULTANEOUS FORMING OF CONCRETE FOOTINGS AND PIERS

[76] Inventor: Gordon T. Wells, 27 School St., Northfield, Vt. 05663

[21] Appl. No.: 33,665

[22] Filed: Apr. 3, 1987

Related U.S. Application Data

[62] Division of Ser. No. 797,502, Nov. 13, 1985, Pat. No. 4,673,157.

[51] Int. Cl.[4] ..... E02D 5/44; E02D 7/00

[52] U.S. Cl. ..... 405/239; 405/231; 405/232; 405/233

[58] Field of Search ..... 405/233, 236, 237, 238, 405/239, 251, 252, 255, 244, 256, 257; 249/143, 13, 51, 155

[56] References Cited

U.S. PATENT DOCUMENTS

| | | | |
|---|---|---|---|
| 783,901 | 2/1905 | Sheldon | 249/51 |
| 785,356 | 3/1905 | Gow et al. | 405/238 |
| 1,062,718 | 5/1913 | Layne | 405/239 |
| 1,296,995 | 3/1919 | Miller | 405/238 |
| 4,047,356 | 9/1977 | De Pirro | 249/51 X |
| 4,623,025 | 11/1986 | Verstraeten | 405/236 X |

FOREIGN PATENT DOCUMENTS

| | | | |
|---|---|---|---|
| 0029917 | 2/1983 | Japan | 405/238 |
| 3841 | 10/1919 | Netherlands | 405/237 |

*Primary Examiner*—Randolph A. Reese
*Assistant Examiner*—John A. Ricci
*Attorney, Agent, or Firm*—Solon B. Kemon

[57] ABSTRACT

The method of forming footings and piers in concrete construction includes excavating to accommodate placement of a two-part mold. The upper mold part is for the pier and interfits and communicates with the lower footing mold so that both may be poured at the same time through the upper pier part.

2 Claims, 1 Drawing Sheet

FIG. 1
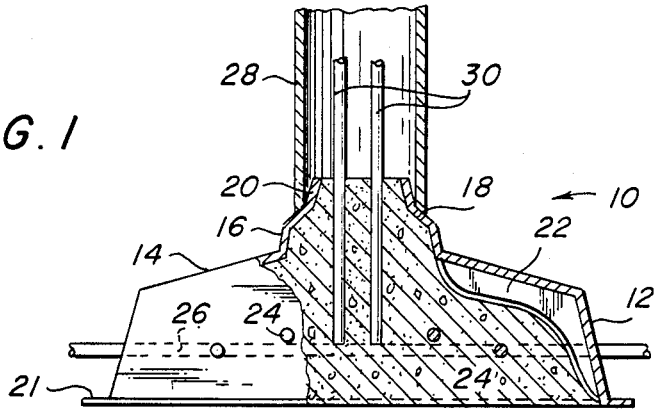
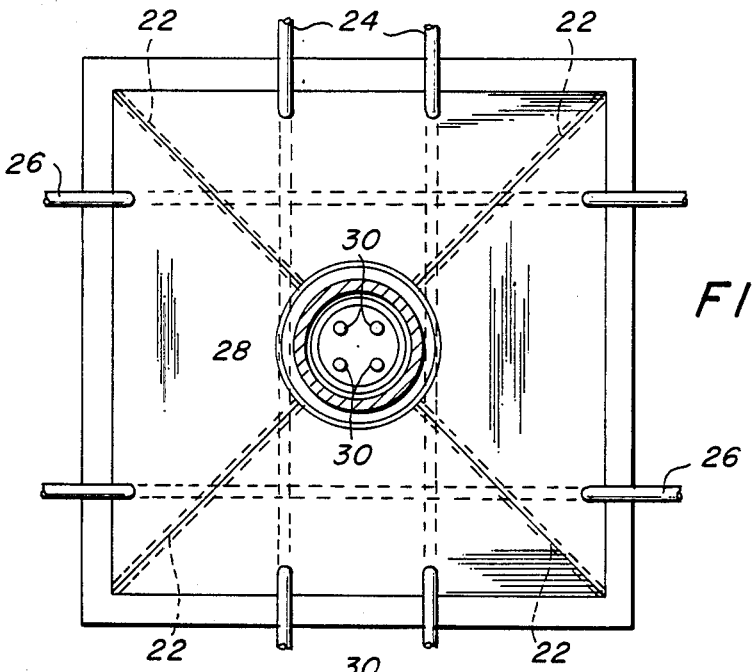
FIG. 2
FIG. 3
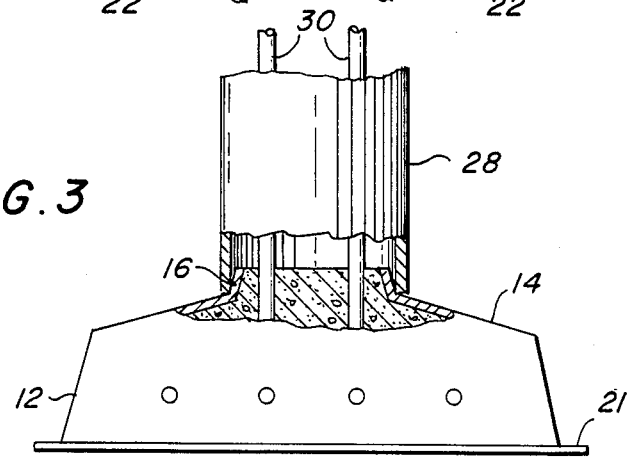

METHOD FOR SIMULTANEOUS FORMING OF CONCRETE FOOTINGS AND PIERS

This is a division, of application Ser. No. 797,502, filed Nov. 13, 1985, now U.S. Pat. No. 4,673,157.

BACKGROUND OF THE INVENTION

Concrete foundation construction which involves the formation of footings and piers, as now practiced, includes basically a series of separate steps which generally speaking are necessarily performed on successive days. First the site is excavated to the required depth of the footings and then a form is constructed which is placed in the bottom of the excavation. Rebar is placed in the form both longitudinally and vertically so that when the footing is poured the vertical rebar will extend above the footing at the desired location of a pier. The next day, after the footing has set, a hollow fiber pier form known in the construction industry by its trade name (SONOTUBE) is supported on the footing around the protruding rebar and then piers are poured at spaced points or at center of individual footings. Lastly, the excavation is back filled around the footing and piers.

BRIEF DESCRIPTION OF THE INVENTION

The present invention is directed to a one-time-use footing form usable in concert with conventional (SONOTUBES) of different diameters so that piers and footings can be poured at the same time. This allows all excavation and backfill to be done in one day prior to pouring of the concrete. Also the concrete is all poured on the same day resulting in significant savings in labor costs, as well as expediting the entire project.

BRIEF DESCRIPTION OF THE DRAWINGS

FIG. 1 is a side elevation partially in section showing a footing form in accordance with the present invention and its method of use with a pier form;

FIG. 2 is a top plan view of FIG. 1; and

FIG. 3 is a view similar to FIG. 1, but with the uppermost sections of the footing forms removed to permit use with a larger diameter pier form.

DETAILED DESCRIPTION

Referring now to the drawing which shows the preferred embodiment, the footing form 10 is a hollow one piece molding of interconnected step-tapered sections 12, 14, 16, 18 and 20 bordered at the base by the flange

21. As shown in FIG. 1, the form is open at its bottom and preferably reinforced at each corner by integral vertical ribs 22. Knock outs 24 are provided in the side walls for the insertion of rebars 26 in a substantially horizontal plane. The center opening in the topmost section 20 is sized to receive a standard size commercially available pier form 28 sold under the trademark (SONOTUBE). Additional rebar members 30 may be vertically disposed in the pier form.

In FIG. 3, two upper sections 18 and 20 of the form 10 have been removed to accomodate a larger diameter pier form but the use is otherwise the same as illustrated in FIG. 1. Preferably, the form 10 is molded to facilitate easy removal of the upper sections in the field depending on the diameter pier form to be used. This permits the footing form to be mass produced in a single mold and yet adaptable in the field for use with different diameter pier forms.

As will be apparent to those skilled in this art, the present invention permits substantial economy in the construction of concrete footings and piers because all excavation and backfill can be done at the same time and then the pier and footing are poured simultaneously through the pier form when inserted onto the footing form and this minimizes labor costs. The form is preferably molded of any conventional plastic material making it ideally suited for one-time-use and capable of being mass produced at minimum cost.

While a preferred embodiment has been herein shown and described, applicant claims the benefit of a full range of equivalents within the scope of the appended claims.

I claim:

1. A method of simultaneous forming of concrete footings and piers comprising:

(a) excavating a footing hole to the required size and depth;

(b) placing a one time use hollow imperforate footing form on the bottom of said excavation;

(c) inserting a hollow imperforate vertically extending pier form onto said footing form;

(d) backfilling around the thus assembled forms; and (e) pouring concrete into the upper end of the pier form to fill both forms.

2. A method as defined by claim 1 which includes the steps of positioning rebar horizontally through the footing form and vertically within the pier form prior to the concrete pouring step.

* * * * *